United States Patent [19]

Workum

[11] Patent Number: 4,798,311

[45] Date of Patent: Jan. 17, 1989

[54] CONTAINER PROVIDED WITH A CLOSURE

[75] Inventor: Donald J. Workum, Küsnacht, Switzerland

[73] Assignee: Hafina Treufinanz AG, Baar, Switzerland

[21] Appl. No.: 865,724

[22] PCT Filed: Jul. 8, 1985

[86] PCT No.: PCT/CH85/00109

§ 371 Date: Jun. 4, 1986

§ 102(e) Date: Jun. 4, 1986

[87] PCT Pub. No.: WO86/01489

PCT Pub. Date: Mar. 13, 1986

[30] Foreign Application Priority Data

Aug. 23, 1984 [CH] Switzerland ..... 4034/84

[51] Int. Cl.[4] ..... B65D 37/00

[52] U.S. Cl. ..... 222/131; 222/212; 222/496

[58] Field of Search ..... 222/206, 209, 212, 215, 222/386.5, 478–479, 481–482, 491–497, 519–521

[56] References Cited

U.S. PATENT DOCUMENTS

| | | | |
|---|---|---|---|
| 2,009,552 | 7/1935 | Jaen | 222/496 |
| 2,170,588 | 8/1939 | Douglas | 222/ |
| 2,185,323 | 1/1940 | Arnold | 222/496 |
| 2,628,004 | 2/1953 | Schlicksupp | 222/493 |
| 3,008,611 | 11/1961 | Mancusi, Jr. | 222/496 X |
| 3,592,365 | 7/1971 | Schwartzman | 222/209 |
| 3,913,803 | 10/1975 | Laauwe | 222/493 X |
| 4,102,476 | 7/1978 | Loeffler | 222/209 |
| 4,141,475 | 2/1979 | Nilson | 222/494 |
| 4,402,434 | 9/1983 | Baker | 222/492 |
| 4,420,100 | 12/1983 | Mueller | 222/212 X |
| 4,513,891 | 4/1985 | Hain et al. | 222/494 X |
| 4,533,068 | 8/1985 | Meierhoefer | 222/189 |

FOREIGN PATENT DOCUMENTS

| | | | |
|---|---|---|---|
| 2704164 | 8/1978 | Fed. Rep. of Germany | 222/212 |
| 1318786 | 12/1963 | France | 222/491 |
| 473713 | 7/1969 | Switzerland | 222/492 |

*Primary Examiner*—Michael S. Huppert

*Attorney, Agent, or Firm*—Foley & Lardner, Schwartz, Jeffery, Schwaab, Mack, Blumenthal & Evans

[57] ABSTRACT

In an outer container (1) there is disposed an inner container (2) which contains the product to be withdrawn in portions. On the top of a container cover (4) there is a diaphragm-like body (6) with a bore (7) for the emergence of the product. When not in use, the diaphragm-like body (6) lies tightly against a plug (8) which closes the bore (7). The plug (8) is joined by ribs (10) to a ring (11) to which the inner container, consisting of soft material, is fastened. The container cover (4) and the ring (11) are joined together by interlocking. When the outer container (1) is squeezed a pressure develops in the interstice between the two containers, which interstice can be shut off by an air valve (15), and by this pressure a certain amount of the product is forced out of the inner container (2) between the plug (8) and the yielding diaphragm-like body (6), whereupon the diaphragm-like body (6) returns again to the sealing position. The product is thus always protected against the access of air.

16 Claims, 8 Drawing Sheets

FIG. 3
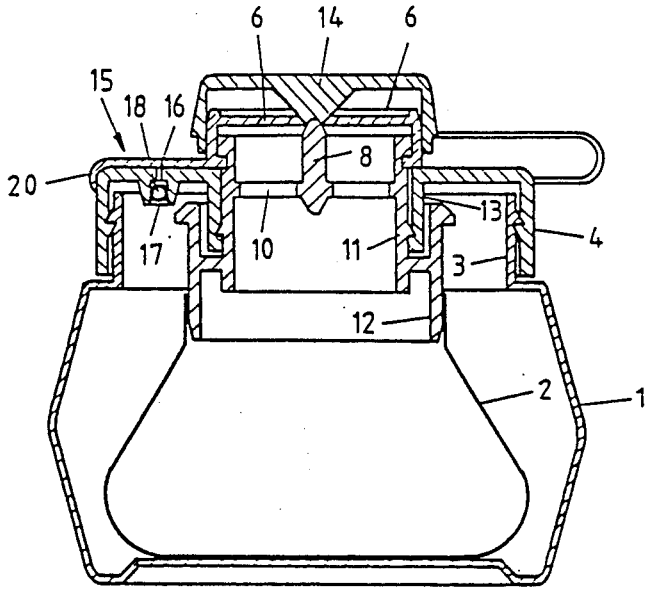
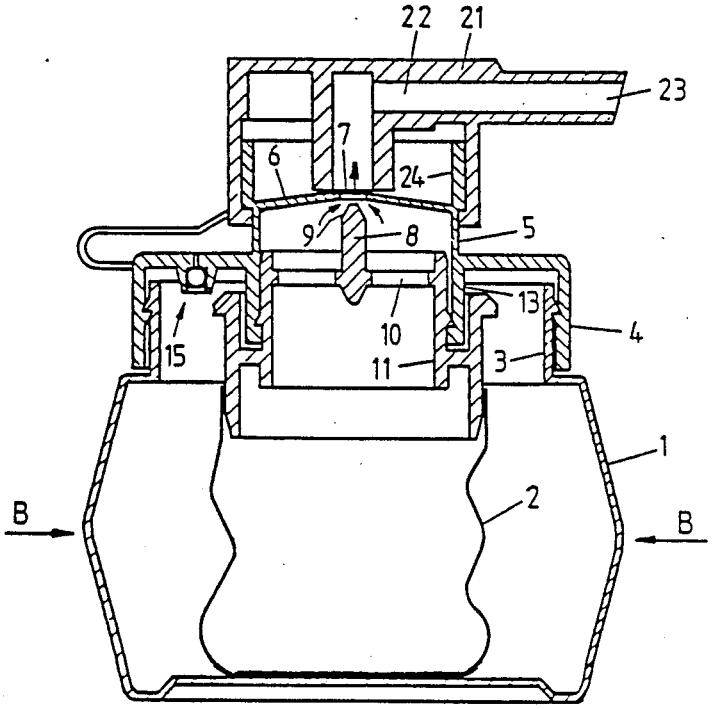
FIG. 4

CONTAINER PROVIDED WITH A CLOSURE

The invention relates to a container having a closure, for the accommodation of fluid products which can be removed in portions by the application of pressure to the flexible container.

The term "fluid products" is to be understood to mean all liquids as well as pastes and creams of different consistencies, and foods of comparable nature, such as syrup, mustard or ketchup. Thus, containers of this kind, from which a product is forced out by exerting pressure on the container, contain for example liquid soap, lotions, toothpaste, deodorants etc., or foods such as mustard, mayonnaise etc. Many products of this kind are marketed in squeeze tubes, but these tubes have the known disadvantages that one often forgets to replace the screw cap, so that the product dries out, or is altered by the access of air which for example oxidizes it or spoils it. Another disadvantage consists in the fact that tubes that have been squeezed or rolled up from one end are unsightly, when the contents have been withdrawn carelessly and are smeared around the edge of the opening.

Furthermore, a variety of containers for the accommodation of products of the kind described above are known, and are preferably made of soft plastic with valve-like closures. Many of them, however, have the disadvantage that, when in use, they do not work or cannot be actuated at all in some positions, or that, since the center of gravity of the container is unfavorably located, it easily falls over when only partially full. These known closures for the removal of the content in portions usually do not protect the content against undesirable access of air, or from the oxidation or spoilage of the product.

The problem on which the present invention is based was therefore to create a container having a closure, which would be just as inexpensive as a squeeze tube, but which would not have its disadvantages. The container was to permit an amount of the contained product to be withdrawn as often as desired without losing its original external shape, requiring only a pressure on the container without removing a screw closure or having to replace it. The product at the same time was to be able to be sealed off air-tight, again without such a screw closure. The container was to be able to be used while it stands upright on its base or in any other position, and its peripheral surface was to be able to be of any desired shape, such as cylindrical or polygonal, so as to have a great variety of possible configurations. It was furthermore to be possible to reuse the container with a refill.

For the solution of these problems, the container with a closure has the features according to the independent claim 1. Preferred embodiments will be seen in the dependent claims.

The invention is further explained with the aid of the drawings wherein different embodiments of the subject matter of the invention are represented only by way of example.

Figure 1:
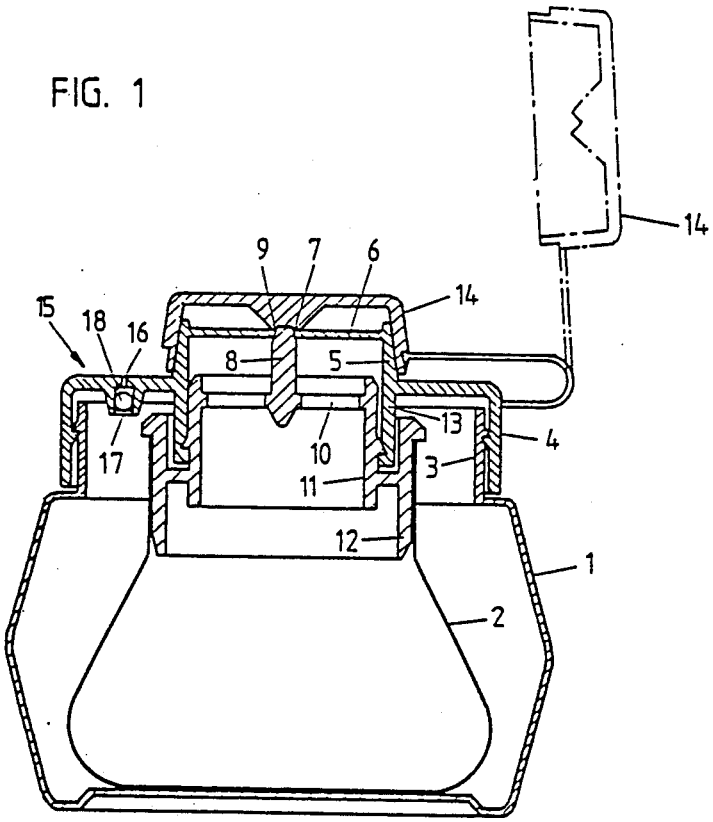
Figure 2:
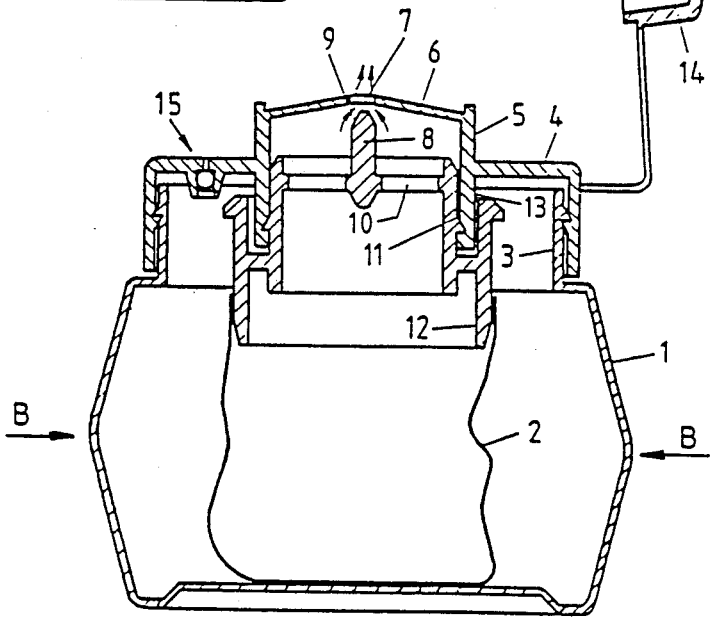
Figure 6:
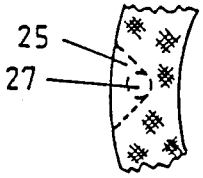
Figure 5:
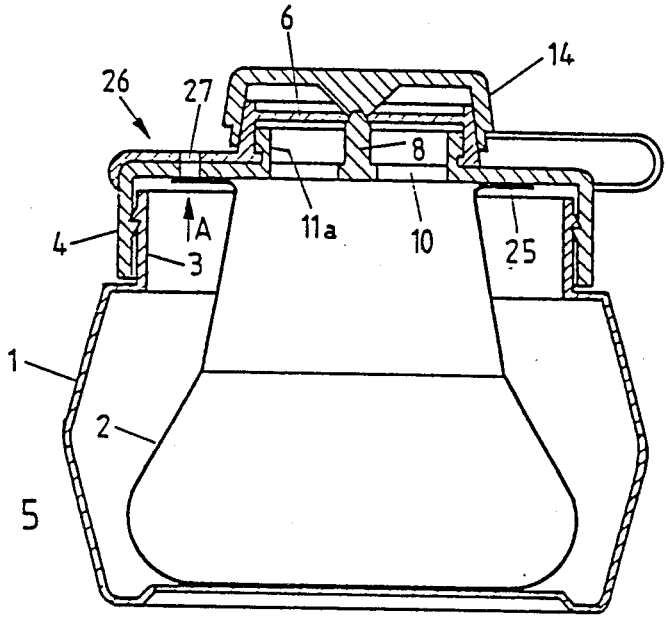
Figure 7:
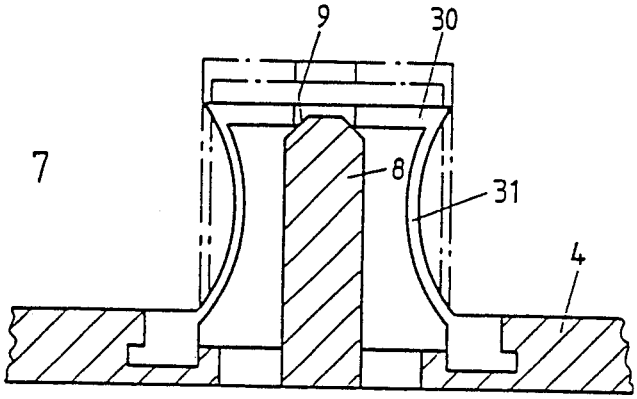
Figure 8A:
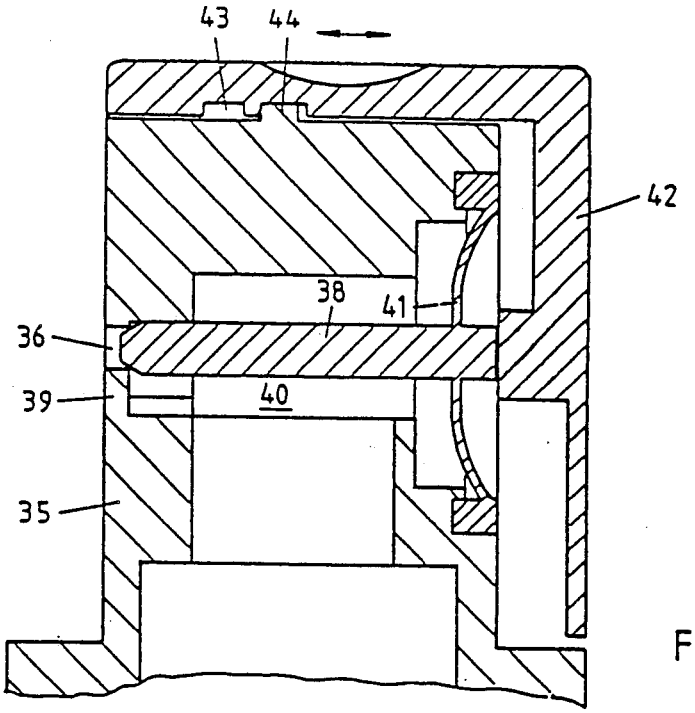
Figure 8B:
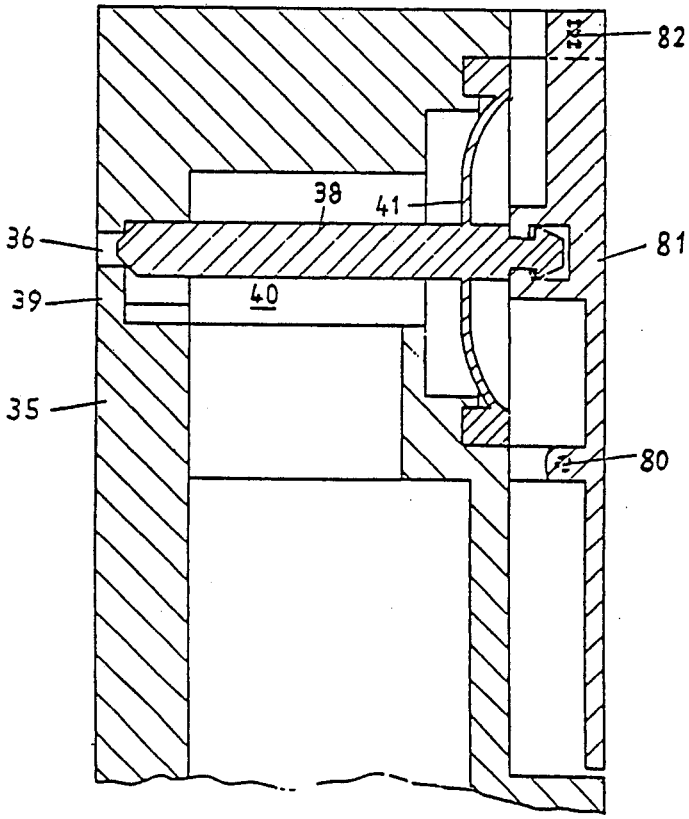
Figure 9A:
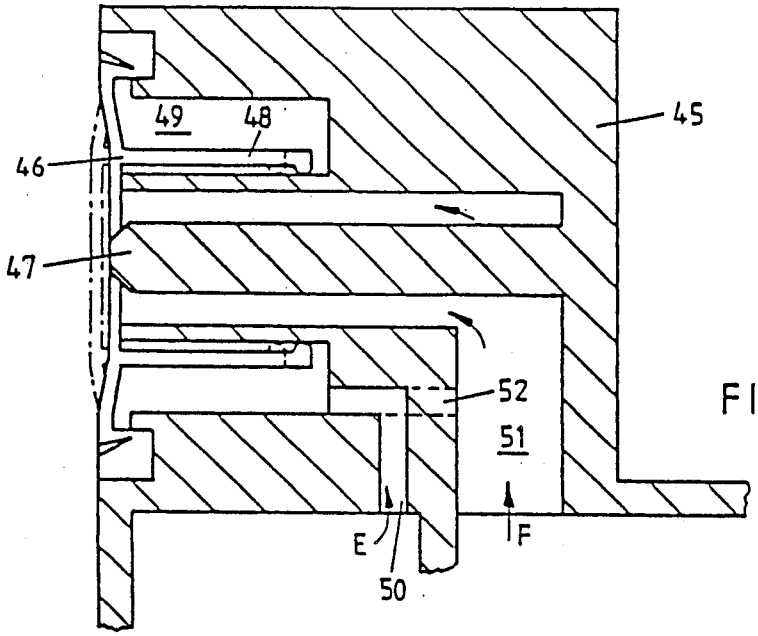
Figure 10:
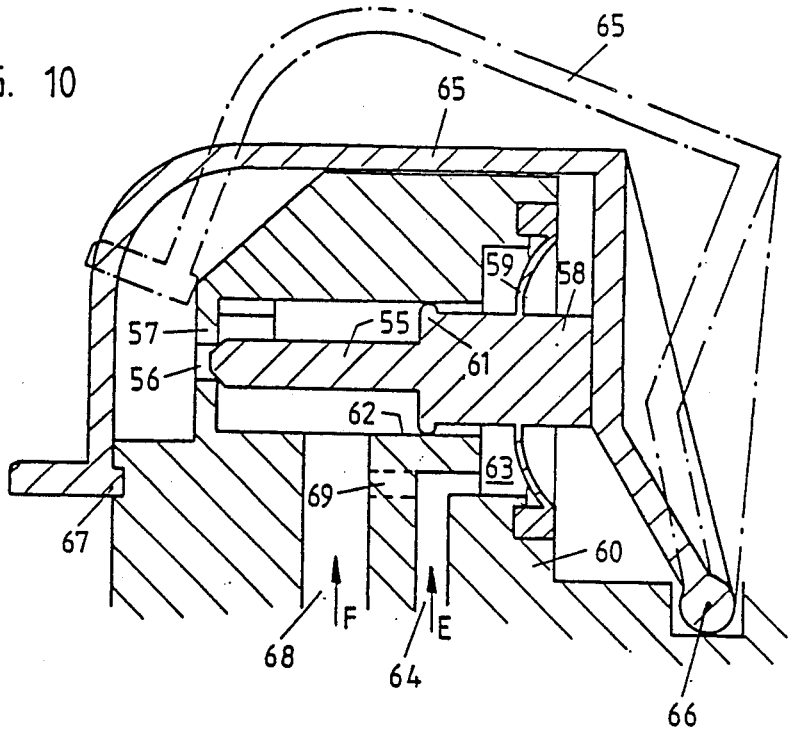

FIG. 1 is a cross section through a double-walled container whose closure is shut, FIG. 2 is a cross section of the container of FIG. 1 whose closure is open, FIG. 3 is a cross section of a container similar to FIG. 1, with a modified embodiment of the container lid, FIG. 4 is a cross section of a double-walled container whose cover has a discharge passage at an angle, FIG. 5 is a cross section through a double-walled container similar to FIG. 3, with a modified embodiment of the air valve, FIG. 6 is a detail in the area of the air valve, as seen in the direction of the arrow A, FIG. 7 is a detail on a larger scale of a variant embodiment of the closure, FIG. 8A is a detail on an enlarged scale of the upper part of the closure of a container which is not shown, showing a modified embodiment having a side orifice and a mechanical lock in the closed state, FIG. 8B is an embodiment similar to FIG. 8A, having a manually operated mechanism for opening and closing disposed opposite the discharge orifice, FIGS. 9A and B represent another modified embodiment of a closure whose orifice can be controlled by air and/or by the fluid product, FIG. 10 shows another embodiment of a closure having an orifice which can be operated by air and/or by liquid products, FIGS. 11, 12, 12A and 13 show four different variants of another embodiment similar to FIG. 10, with an additional air valve for pressure equalization in the container.

The container having a closure according to FIG. 1 has an external container 1 consisting, for example, of plastic material, which is such that the container can be squeezed and then recovers its original shape. In the external container 1 there is disposed an additional thin-walled container 2 which consists of a material which makes it possible for the inner container 2 to be completely emptied upwardly under the action of the pressure prevailing in the interstice between the inner container 2 and the outer container 1. The two containers therefore are not attached to one another at their bottom portion. On the upper margin 3 of the outer container 1 there is placed a container cover 4. This cover has at its top center a cylindrical neck portion 5 which is closed off at the top by a thin-walled, diaphragm-like body 6 which is made preferably of plastic material integral with the neck portion and differs from it only in its thickness. In the diaphragm-like body 6 a bore 7 is formed in its center. A plug 8 having a preferably conical sealing surface 9 engages this bore. The plug 8 is fixedly joined to a cylindrical ring 11 which is integral with an additional ring 12 to which the inner container 2 is fastened at its upper margin. An annular portion 13 of the container cover 4 is engaged between the two rings 11 and 13 in order to produce a strong and tight junction between the container cover 4 and the portion consisting of the two rings 11 and 12, the junction being accomplished in a known manner by means of a snap-fastening bead.

In non-use, a cap 14 is additionally placed on the cylindrical neck portion 5. With a projection disposed in its center, this cap presses the diaphragm-like body 6 against the plug 8 to doubly assure a tight seal. The diaphragm-like body 6, consisting preferably of plastic material, has an inherent bias such that the discharge orifice 7 is always closed and the access of air to the product in the inner container 2 is prevented.

In the container cover 4 there is furthermore provided an air valve 15. This consists of an offset bore 16 which is closed off at the bottom by a screen in the form of a perforated disk 17. In the expanded portion of the through-bore 16 there is provided a ball 18 above the screen 17 which can close off the narrower portion of the through-bore above it. This happens when the outer container 1 is squeezed in the direction of the arrows B in FIG. 2. The ball 18 of the air valve 15 is then in an upper position, so that the air present in the interstice between the outer container 1 and the inner container 2 cannot escape. By means of this air cushion, the product contained in the inner container 2 can be forced upwardly out of the closure in portions. If the pressure exercised by hand on the outer container 1 terminates, air can reenter the interstice between the two containers.

The container can be top-filled with the product or it can be bottom-filled, the container bottom being closed after filling is completed. The inner container 2 can also be configured like the end of a squeeze tube, or it can be made such that, after the contents have been used up, it can be replaced with a fresh container. The inner container 2 can also be coated with aluminum for very aggressive products. To be able to withdraw only a specific amount of product each time, it is also possible to provide, in the interstice between the inner and outer containers, a movement limiter in the form of a ring beyond which the outer container 1 cannot be squeezed.

The embodiment represented in FIG. 3 differs from the embodiments described before only in the different configuration of the diaphragm-like body 6, which is a separate piece so constructed that it can be placed on the upwardly prolonged ring 11 by means of a margin. The diaphragm-like body 6 can be joined directly to the container cover 4 by a laterally appended strap 20 and made integral with the cover out of plastic material. The cap 14 can also be joined to the two parts just referred to by means of a strap made in one piece with them. This simplified embodiment according to FIG. 3 makes it possible to assemble the diaphragm-like body 6 and the cap 14 prior to the filling operation and then install them together on the container cover 4. The connecting strap 20, which is necessary for the simultaneous production of the container cover 4 of the diaphragm-like body 6 and the cap 14 by the injection-molding process, can be severed afterward. For top filling, the outer container 1 can be already provided with the cover 4 and the inner container 2 can already be provided with the rings 11 and 12 fastened to the upper margin, so that then it is necessary only to install the diaphragm-like body 6 together with the cap 14, although of course they can also be installed successively.

The embodiment represented in FIG. 4 is a modification of the embodiment according to FIG. 1, and differs from the latter only in the configuration of the cap 21 which contains in its interior a laterally directed passage 22 leading to a radial discharge nozzle 23. This cap 21 is placed onto an upwardly prolonged neck portion 24 of the container cover 4. The cap 21 makes it possible to let the product emerge in a specific direction. The cap 21 also can be made such that the product emerges vertically when the container is used with the nozzle pointing downwardly. The cap 21 is intended for containers holding a product which is insensitive to the access of air and/or which does not dry out. The cap 21 is pressed downwardly to provide double assurance of an air-tight seal.

The embodiment according to FIGS. 5 and 6 is another simplification of the embodiment according to FIG. 3. The difference is that the inner container 2 is fastened, e.g., by welding the plastic material, directly to the underside of the container cover 4 at an outwardly turned margin 25. In this manner the air valve can be more simply constructed, in that, instead of the ball 18 in FIG. 1, the margin 25 covers the bore 27 in the container cover 4. In FIG. 6 there is represented, as seen in the direction of the arrow A, a section of the margin 25 which is not welded around the bore 27 in the container cap in the area defined by the broken line, so that the margin can lift away from the container cover to allow air to enter into the interstice between the outer container 1 and the inner container 2. When the outer container 1 is squeezed, this air valve closes since the margin 25 covers the bore 27. Another difference consists in the fact that, on account of the inner container 2 extending upwardly all the way to the container cover 4, the ring joined to the inner container 2 in the embodiment according to FIGS. 1 to 4 is not present, and instead a neck 11*a* integral with the cover 4 is connected by the ribs 10 to the plug 8.

The variant represented in enlarged detail in FIG. 7 also has a plug 8 which cooperates with a diaphragm-like body 30, and which is of thimble-like configuration and has an inwardly curved circumferential wall 31 whereby the body made in this shape of plastic material has a bias such that it bears against the top of the plug to close off the discharge orifice. The pressure of the product present in the container then forces the body 30 to the position represented in broken lines, from which the body resiliently returns to the position represented in solid lines.

In FIGS. 8A and 8B, which are enlarged details of the upper part 35 of a closure in which the discharge orifice 36 is disposed not at the top but laterally in the upper part 35. In regard to the valve-like means, in contrast to the previously described embodiments, the principle is here reversed, and the plug 38 moves relative to a stiff facing 39 which closes off the front of the product discharge chamber 40 and is part of the upper part 35 of the closure. In this embodiment, the diaphragm-like body 41 is joined to the plug 38 at a distance from the facing 39, while surrounding the plug annularly and shutting off the chamber 40 in the upper part 35 from the exterior. The diaphragm like body 41 has a closing bias and, under the pressure of the product in chamber 40, yields in the opposite direction so that the discharge orifice 36 is opened.

A cap 42 covering the top and side of upper part 35 in FIG. 8A can be pushed back and forth in the direction of the arrows and can be held in two positions, detents 43 and 44 being provided for this purpose for the two positions. The cap 42 secures the closed position. The embodiment according to FIG. 8A is furthermore equipped with an outer container 1, not shown, and an inner container 2 as in the embodiments according to FIGS. 1 to 5. If, however, only one container holding the product is present, which is in the form of a so-called squeeze bottle into which air must reenter through the discharge opening after withdrawal of a portion of the product, the upper part of this closure is constructed in accordance with FIG. 8B. Here the plug 38 is pulled mechanically downwardly away from the discharge orifice 36 by means of a plate 81 which can pivot about an axis 80, whenever pressure is exerted against the plate 81 below the pivot axis 80. The diaphragm-like body 41 has no bias in this case and the closure remains open because the pivoting plate 81 bears against a slightly projecting detent 82, and not until pressure is applied to the plate above the fulcrum 80 can it be returned to the closed position, in which case the plate snaps over the detent 82.

In a variant that is not shown, the embodiment according to FIG. 8A can also be operated on the rear side instead of the top and the embodiment according to FIG. 8B can be operated at the top.

Figure 9B:
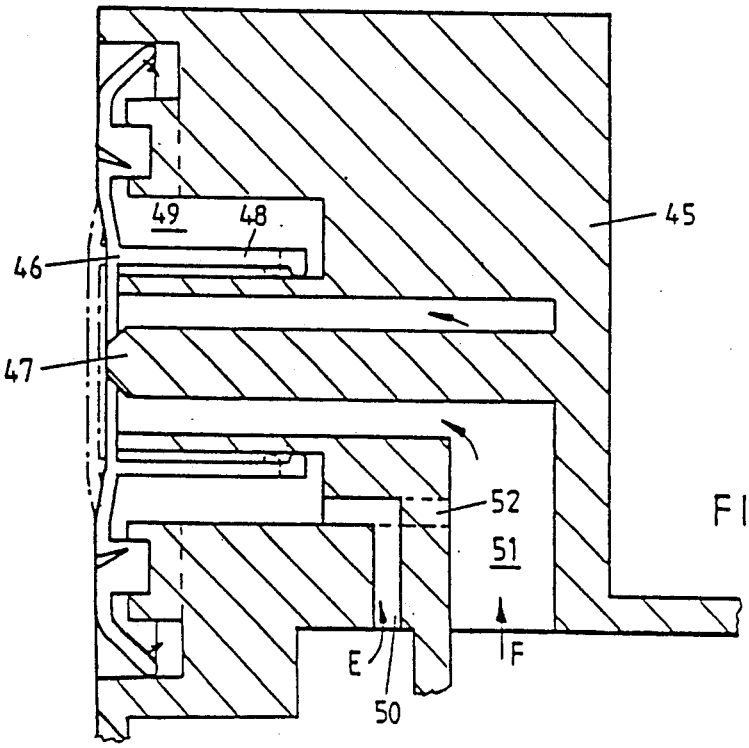

The embodiment represented in FIGS. 9A and 9B likewise has a lateral discharge opening in a slightly differently configured upper part 45 of the closure of the container which is not otherwise represented. In this embodiment, the principle described in the case of the embodiments according to FIGS. 1 to 7 is again employed, a diaphragm-like body 46 lifting away from the plug 47 and then assuming the position represented in broken lines. The diaphragm-like body 46 has a cylindrical prolongation 48 which is guided sealingly in an annular chamber 49. A passage 50 leads into the chamber 49 and carries air under compression in the direction of the arrow E into the annular chamber 49 in order to produce the movement of the diaphragm-like body 46 in the opening direction. The closure top 45 can be placed on a double-walled container which is not shown and which, like the embodiment according to FIG. 1, has between an outer container and an inner container an interstice in which an elevated air pressure is produced by squeezing the outer container, and then it is utilized for the operation of the diaphragm-like body 46. The product then passes from the inner container through the chamber 51 in the direction of the arrow F and along the plug 47 to the discharge orifice. Optionally, a cross bore 52 indicated in broken lines can connect the chambers 49 and 51, so that the diaphragm-like body 46 is moved in the opening direction by the product and by compressed air. When the passage 50 is closed, the product acts exclusively from both chambers 49 and 51 against the diaphragm-like body 46. In the embodiment according to FIG. 9B, the diaphragm-like body is configured at its outer margin as a flexible lipped sealing ring over which air can flow back into the interstice between an outer and an inner container in the case of a vacuum, the cross bore 52 then being closed. If only one container is present for the product, when there is a vacuum in the container, air passes into it over the lipped sealing ring.

The same principle of actuation by air and/or product under pressure is also employed in the embodiment according to FIG. 10, which is indicated by the flow arrows E and F. In this embodiment, however, the principle previously described in conjunction with the embodiment according to FIG. 8A is applied to the opening and closing of the discharge orifice. The plug 55 moves relative to a stiff facing 57 in the upper part 60 of the closure. At the other end the plug section 58 of larger diameter is joined to the diaphragm-like body 59. This body 59 has a closing bias and is fastened sealingly at its outer margin in the upper part 60. Between the plug 55 and its larger-diameter rearward section 58 a portion of it is in the form of a piston 61 which is sealingly movable in the cylindrical bore 62. Between the diaphragm-like body 59 and the piston 61 there is thus a sealed chamber 63 into which the air under compression enters in the direction of the arrow E through the passage 64, so that the plug is moved rightward in the opening direction by the pressure exerted on the diaphragm-like body 59. This is possible only when a cap 64, pivoted about the axis 66 and covering the upper part 60, has been brought to the position represented in broken lines. In the closed position, the cap 65, by pressing against the rearward end of the plug 55, locks the latter in the closed position. The cap 65 is held in this position by a snap-fastening projection 67. The plug 55–58 and the diaphragm-like body 59 consists preferably integrally of plastic material. Optionally, the product flowing through the passage 68 can here too be directed through a cross bore 69 against the diaphragm-like body 59.

If the product is held in only a single container which is made of flexible plastic material in the form of a so-called squeeze bottle, air has to get back into the container on the exit path of the product. The embodiments according to FIGS. 11 to 13 differ, therefore, from the embodiment according to FIG. 10 in that no passage 64 is available for the entry of air and the piston-like part 61 on the plug 55 is lacking. The product entering through the passage 68 arrives at the diaphragm-like body 59 in order to move the plug 55 in the opening direction. The diaphragm-like body 59, which has a bias in the closing direction, has a lipped sealing margin 70 radially outside of its fastening margin, which is resiliently urged, since the material consists of plastic, against a ring 71 joined to the upper part 60, and which is lifted when a vacuum prevails in the container and allows air to enter into the container.

Figure 12:
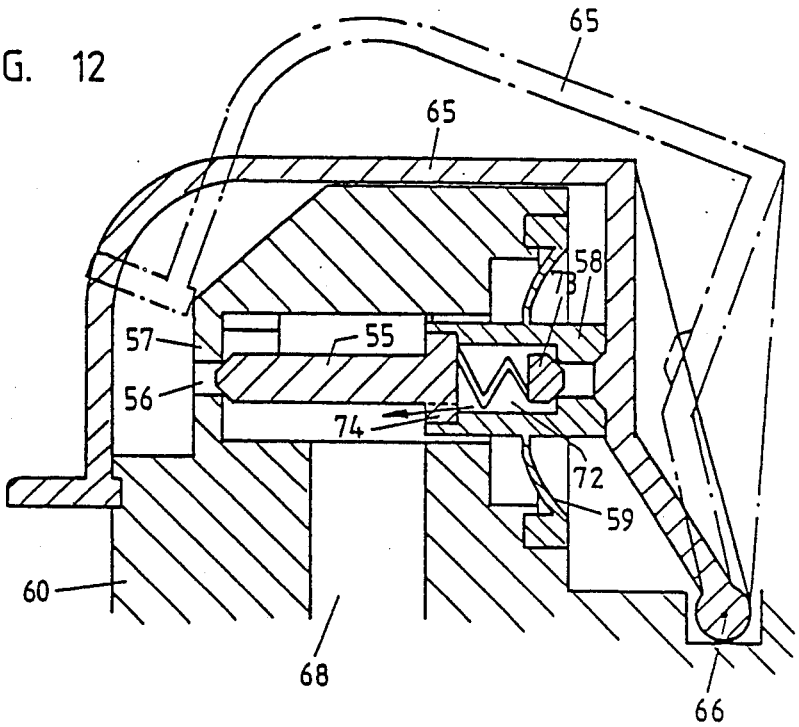

In the embodiment according to FIG. 12, a cavity 72 open toward the rearward end of the plug is formed within the part of larger diameter 58 of the plug 55, and an air valve 73 is disposed in this cavity which is held in the closed position by spring action. The cavity 72 is connected by a bore 74 to the chamber through which the product flows.

Figure 13:
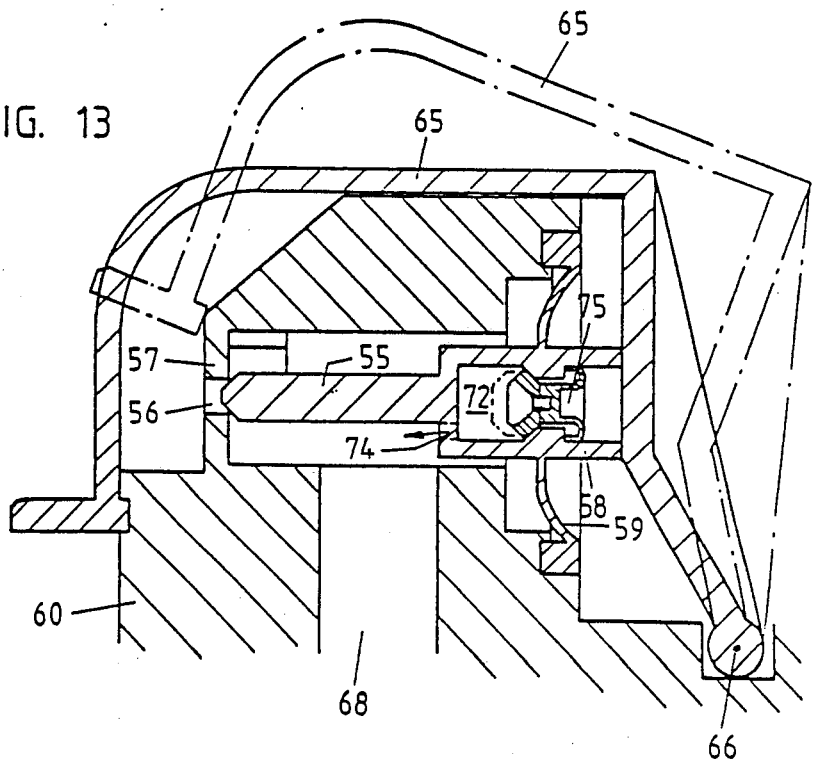

In the embodiment according to FIG. 13, a differently constructed valve 75 is disposed at the same point within the plug section 58. Otherwise the embodiments are alike.

Figure 11:
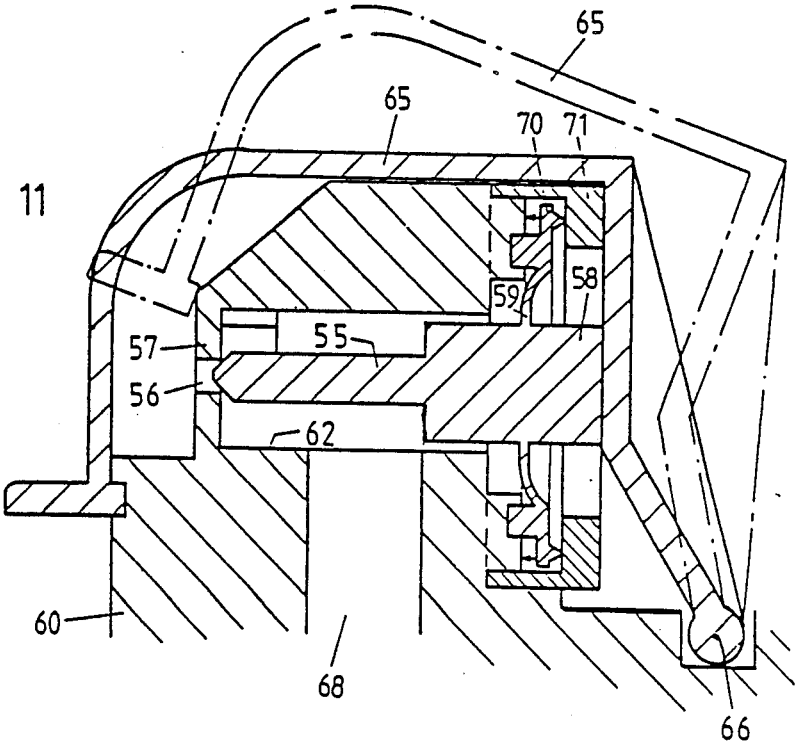
Figure 12A:
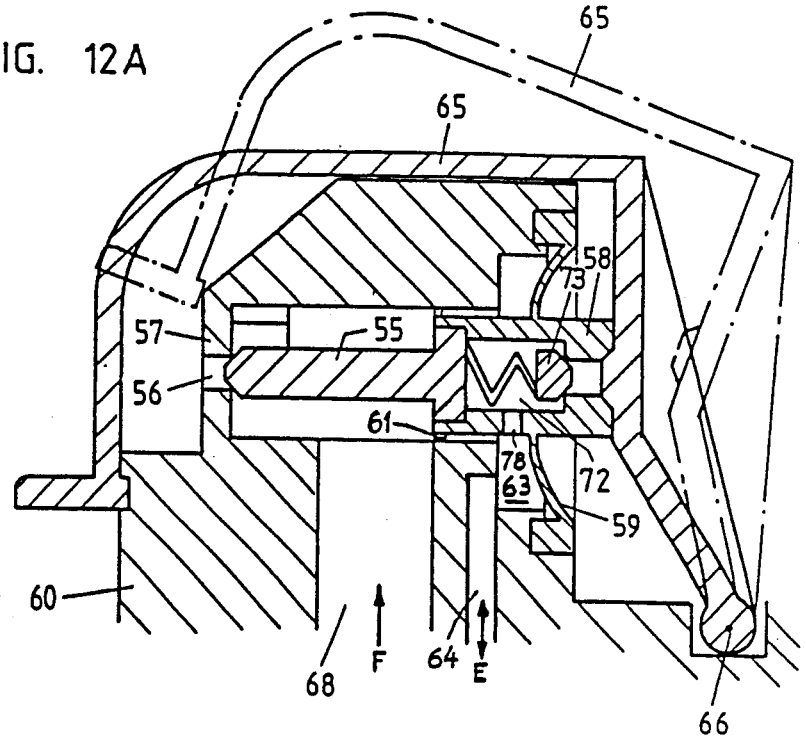

All three embodiments according to FIGS. 11, 12 and 13 can be modified as represented, for example, in FIG. 12A. In this case the part 58 of the plug 55–58 is in the form of a piston 61, so that a sealed chamber 63 is present which is in communication through a passage 64 with the interstice between an outer container 1 and an inner container 2, and furthermore the chamber 63 is in communication with the cavity 72 in the plug portion 58 through a bore 78. On the path of flow thus established, the air can flow back, after the withdrawal of a certain amount of the product, into the interstice between the inner and outer containers and no air valve 15 is required in the container cover as it is in the embodiments according to FIGS. 1 to 4.

The different kinds of the closure described above can be used for different types of containers, the different types of closures being used according to the nature of the material they are to contain.

If an outer container and an inner container are present, the valve-like system in accordance with FIGS. 1 to 5, 7, 8A, 9 A and B, 10 and 12A can be used, as well as 11 and 13 corresponding to 12A. If no inner container is present and the product is contained in only one container, the types of closures according to FIG. 8B and according to FIGS. 11 to 13 can be used.

For a squeeze tube consisting of metal, such as for example a toothpaste tube, the types of closure according to FIGS. 1 to 5, 7 and 8A and 9A are suitable. Also, for such a tube consisting of plastic material, the closures types of FIGS. 1 to 5 as well as 7, 8A and 9A can be used, in which case the plastic tube then keeps the deformed shape. If the closure types of FIGS. 8B and 9B as well as 11 to 13 are used, a plastic tube will regain its original shape after an amount of its content has been squeezed out. The advantage is found in all variants that the closure is functional with the container in any position.

I claim:

1. An apparatus, comprising:

a flexible container for a flowable product which can be dispensed in portions by the application of pressure to the container, said container having a first opening; and a closure for the container, said closure being positioned over said opening and including an outlet valve which can be actuated by pressure from within said container, said closure with said outlet valve comprising:

a first member including a plug having a face with a sealing surface, and a support structure for said plug;

a second member having a second opening aligned with said plug, said plug being receivable in said second opening;

means defining a product flow path extending from said first opening to a position adjacent said plug such that communication with said second opening is blocked by said plug when said plug is received in said second opening;

means for moving said first and second members relative to each other from a position in which said plug is in engagement with said second opening to block said communication to a position in which said plug is spaced from said second opening to allow communication between said product flow path and said second opening such that said product can flow from said container, said moving means permitting one of said first and second members to move, and means defining a pressure flow path extending from said container to a position adjacent said movable member for transmitting pressure from said container to said movable member to space said plug from said second opening, said moving means causing said pressure flow path and said product flow path to be completely separate from each other when said plug is engaged in said second opening and when said plug is spaced from said second opening.

2. An apparatus according to claim 1, wherein the means for moving one of said members comprises a piston joined at an end section of the plug opposite the sealing surface of the plug, said piston being guided in a cylindrical passage formed in said closure so that the plug is movable relative to tee second opening, and further including a portion of said closure which has a chamber sealed from the outside atmosphere by a diaphragm-like body at one end thereof and sealed by the piston at the other end thereof, said pressure flow path comprising a passage that communicates said container with the chamber.

3. An apparatus according to claim 1 wherein said second member comprises a diaphragm-like body containing said second opening, and wherein said pressure flow path ends adjacent said diaphragm-like body for directing pressure from said container to said diaphragm-like body to force said diaphragm-like body out of engagement with said plug.

4. An apparatus according to claim 3 wherein said diaphragm-like body includes a portion sealingly engaging an outer wall of said means for defining said product flow path to separate said pressure flow path from said product flow path.

5. An apparatus according to claim 3, wherein the container is a double-walled configuration including an external container and an internal container with an air space therebetween, said internal container containing the product and communicating with said flow path, said air space between the internal container and the external container communicating with said pressure flow path such that the diaphragm-like body lift away from the sealing surface of the plug under the effect of pressure.

6. An apparatus according to claim 3 further comprising an air vent means for permitting air to flow into said container, said vent means comprising a flexible lip on an outer circumference of said diaphragm-like body.

7. An apparatus, comprising:

a flexible container for a flowable product which can be dispensed in portions by the application of pressure to the container, said container having a first opening; and a closure for the container, said closure being positioned over said first opening and including an outlet valve which can be actuated by pressure from within said container, said closure with said outlet valve comprising:

a housing having a cavity;

a second opening formed in said housing;

a plug disposed in said cavity within said housing, said plug having one end having a face with a sealing surface;

a support structure for said plug for movably supporting said plug such that said plug can move between a first position in which said plug sealing surface engages said second opening and a second position in which said plug is spaced from said second opening, said support structure including a reaction surface attached to said plug on an end opposite said sealing surface, a flexible diaphragm-like body attached to said reaction surface, said flexible diaphragm-like body having an outer periphery sealingly connected to said housing to form a chamber having said diaphragm-like body at one end and said second opening at another end;

a product flow path defined in said housing and extending from said container to said chamber, said product flow path opening into said chamber at a position between said second opening and said reaction surface; and an air valve disposed in said reaction surface and communicating from ambient to said product flow path.

8. An apparatus according to claim 7 wherein said second opening is directed horizontally and said reaction surface faces horizontally.

9. An apparatus according to claim 7, including means for holding the air valve in a closed position by spring action when no pressure is applied to said container.

10. An apparatus according to claim 7, further including an air vent means for permitting air to flow into said container, said vent means comprising a lipped sealing ring formed on the outer circumference of the diaphragm-like body.

11. An apparatus according to claim 7 further including a seal between said reaction surface and an inner housing wall defining said cavity, said flow path ending between said seal and said second opening, and including a pressure path formed in said housing between said container and said cavity between said seal and said diaphragm-like body.

12. An apparatus according to claim 11, further including a transverse bore communicating with the product flow path and the pressure path through the housing.

13. An apparatus according to claim 11, wherein the container comprises a double walled structure having an inner container portion and an outer container portion, said inner container portion containing said product, and said product flow path being in communication with said inner container portion, said outer container portion containing air and said pressure path communication with said outer container portion.

14. An apparatus according to claim 13 wherein the diaphragm-like body has an outer margin configured as a lipped sealing ring over which air can flow back into the outer container portion.

15. An apparatus according to claim 7, wherein the plug and the diaphragm-like body are of integral construction and comprises plastic.

16. An apparatus according to claim 7, wherein the closure housing includes an upper part which contains the plug, and wherein the closure includes a pivoting cap enveloping the upper part of the closure housing such that the cap secures the plug in the closed position.

* * * * *